United States Patent [19]

Dyer

[11] Patent Number: 4,467,482

[45] Date of Patent: Aug. 28, 1984

[54] FLOAT VALVE ASSEMBLY

[76] Inventor: Arthur M. Dyer, 1949 Washington St., Lemon Grove, Calif. 92045

[21] Appl. No.: 476,581

[22] Filed: Mar. 18, 1983

[51] Int. Cl.[3] ..... E03D 1/35

[52] U.S. Cl. ..... 4/393; 4/394; 4/395

[58] Field of Search ..... 4/382, 391–394, 4/395–397, 378, 399, 400–402

[56] References Cited

U.S. PATENT DOCUMENTS

| | | | |
|---|---|---|---|
| 272,020 | 2/1883 | Bennor | 4/396 X |
| 2,660,194 | 11/1953 | Hoffman | 4/395 X |
| 2,970,319 | 2/1961 | Lassiter | 4/393 |
| 3,384,906 | 5/1968 | Hamilton | 4/397 |
| 4,155,128 | 5/1979 | Dyer | 4/393 X |

*Primary Examiner*—Charles E. Phillips
*Attorney, Agent, or Firm*—Charles C. Logan, II

[57] ABSTRACT

A float valve assembly for a water closet that has perfect seating control. The float valve can only move in an up and down direction and cannot move sideways. The float valve assembly has a float member that forms a valve which cooperates with a valve seat for opening and closing the flushing opening of the outlet coupling of the water closet. A pair of laterally spaced wire arm members have their one end pivotally attached to the top of the float member and their other end are pivotally attached to a C-shaped clamp that snaps onto the overflow tube within the water closet. A string-like member has its one end attached to the top of the float member and its opposite end can be attached to the free end of the actuating arm within the water closet.

8 Claims, 5 Drawing Figures

FLOAT VALVE ASSEMBLY

BACKGROUND OF THE DISCLOSURE

The present invention relates to a water closet tand and more particularly to the float valve assembly for controling the flow of water from the tank.

Water closet tanks are provided with a drain opening having a valve seat about the opening. A float valve, normally held in place by water pressure thereabove, prevents the escape of water through the drain. However, when the float valve is lifted off the seat a sufficient distance, far enough to prevent the outgoing water from drawing the valve downwardly, it will rise to the surface of the water and after rising to the surface, it falls with the surface as the water recedes in the tank. When the level of the water recedes to the height of the valve seat, the float valve is reseated on the valve seat by the suction of the water which has been drawn downwardly through the drain opening and while this suction force is being maintained, the fresh supply of water flowing into the water closet tank will cover the top of the float valve and the weight of this water is sufficient to maintain the valve on its seat.

It is an object of the invention to provide a novel float valve assembly that can be retro-fitted to the majority of existing water closet tanks.

It is another object of the invention to provide a novel float valve assembly that has perfect seating control due to fact that it moves only in an up and down direction and cannot move laterally side to side.

It is another object of the invention to provide a novel float valve assembly that has a float valve made of polyvinyl chloride foam, which is one of the most efficient nondeteriorating sealants known.

It is another object of the invention to provide a novel float valve assembly having a C-shaped clamp adaptor that allows it to be clamped onto the overflow tube.

It is a further object of the invention to provide float valve assembly that has a supplemental float member whose fixed position may be raised or lowered to adjust the amount of water that is released upon flushing the toilet.

SUMMARY OF THE INVENTION

Applicant's novel float valve assembly is easily attached to the vertical overflow tube within the water closet tank. This is accomplished by snapping the C-shaped clamp of the assembly over the vertical over flow tube. Depending downwardly from the opposite lateral sides of the C-shaped clamp are a pair of arm members whose top ends are pivotally attached to the C-shaped clamp member and whose lower ends are pivotally attached to the top of the float member that forms a valve which cooperates with the valve seat for opening and closing the flushing opening of the outlet coupling within the water closet tank.

The float member is disc shaped and has a diameter larger than the diameter of the valve seat. The float member is made of polyvinyl chloride foam material, which is one of the most efficient non-deteriorating sealants known. The top of the float valve member is a layer of hard plastic material and it has a block member attached to its top surface which captures the lower end of the arm members. The arm members are formed from an integral piece of wire and the lower ends of the arm members have a laterally extending connecting member that is captured within a laterally extending groove in the block member. The length of the connecting member is only slightly longer than the length of the channel within the block member, thus limiting the amount of lateral travel that the float member may take. The float member therefore is essentially limited to an up and down motion of travel. A limiting stop member is attached to the top of the block member for controlling the degree of arc that the float member can pivot with respect to the arm members.

A flexible string-like member is attached to the top of the block member and its upper end is detachably secured to the free end of the actuating arm of the water closet tank. The novel float valve assembly has been designed to provide perfect seating control, to prevent leakage between the float member and the valve seat, and to prevent hangups by the flexible member that is attached to the top of the float member and also to the free end of the actuating arm.

DESCRIPTION OF THE PREFERRED EMBODIMENT

Applicant's novel float valve assembly will be described by referring to FIGS. 1–3.

Figure 1:
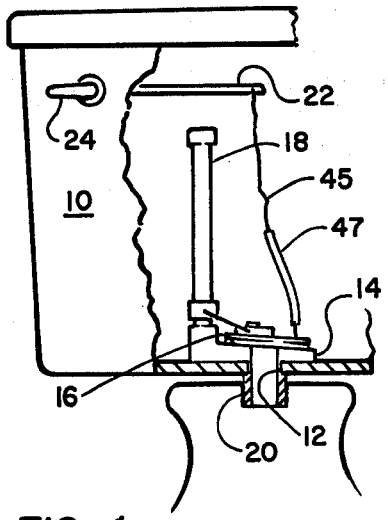
FIG. 1 is a partial side elevation view of a water closet tank illustrating the novel float valve assembly in its proper position.

In FIG. 1 the water closet flush tank 10 is illustrated having an opening 12 in its bottom and an outlet coupling 14 located in this opening. The top of the outlet coupling is open and forms a valve seat 16. A substantially vertically oriented overflow tube 18 has its lower end connected to outlet coupling 14 at a height below the top edge of valve seat 16. A flushing drain pipe 20 is connected to the lower end of outlet coupling 14. An actuating arm 22 has its one end connected to the external lever 24 that is used to flush the water closet.

Figure 2:
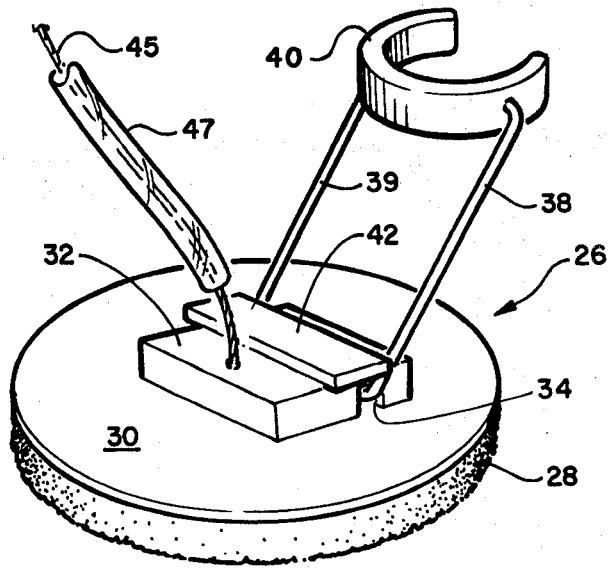
FIG. 2 is a perspective view of the novel float valve assembly.
Figure 3:
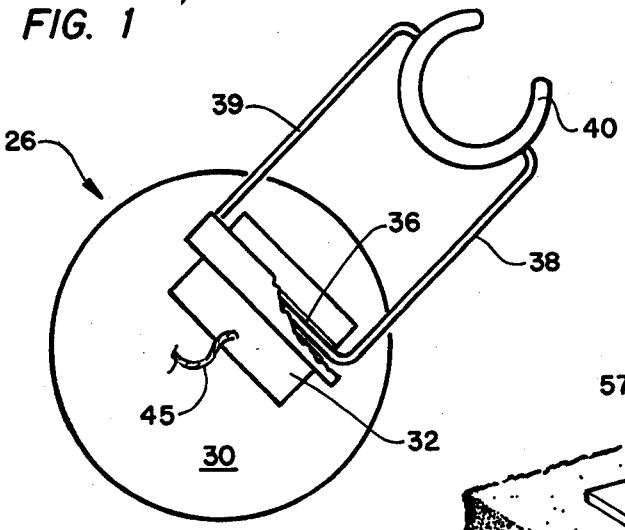
FIG. 3 is a top plan view of the novel float valve assembly.

The novel float valve assembly is generally designated numeral 26 and is best describe by referring to FIGS. 2 and 3. It has a float mamber 28 which is disc shaped and of a diameter larger than that of the diameber of the valve seat 16. Float member 28 is preferably made of a polyvinyl chloride foam material. The top surface of float member 28 has a hard sheet 30 of plastic material attached thereto and block member 32 is attached to its top surface. Block member 32 has a laterally extending channel 34 which receives the wire connecting member 36 that is integrally formed with the lower ends of arm members 38 and 39. The length of connecting member 36 is only slightly longer than the width of block member 32 to thereby prevent lateral motion and misalignment of the disc shaped float member 28 as it reseats itself. The top end of arm members 38 and 39 are pivotally attached to the respective opposite sides of C-shaped clamp 40. A limiting stop member 42 is attached to the top of block member 32 and its width is greater than that of block member 32 thereby limiting or controlling the amount of arcuate travel of arm members 38 and 39 as they pivot in channel 34. A flexible string-like member 45 has its lower end attached to the top of block member 32 and its top end detachably secured to the free end of actuating arm 22. A short length of plastic tube 47 helps to prevent string-like member 45 from becoming entangled in any of the adjacent structure.

Figure 4:
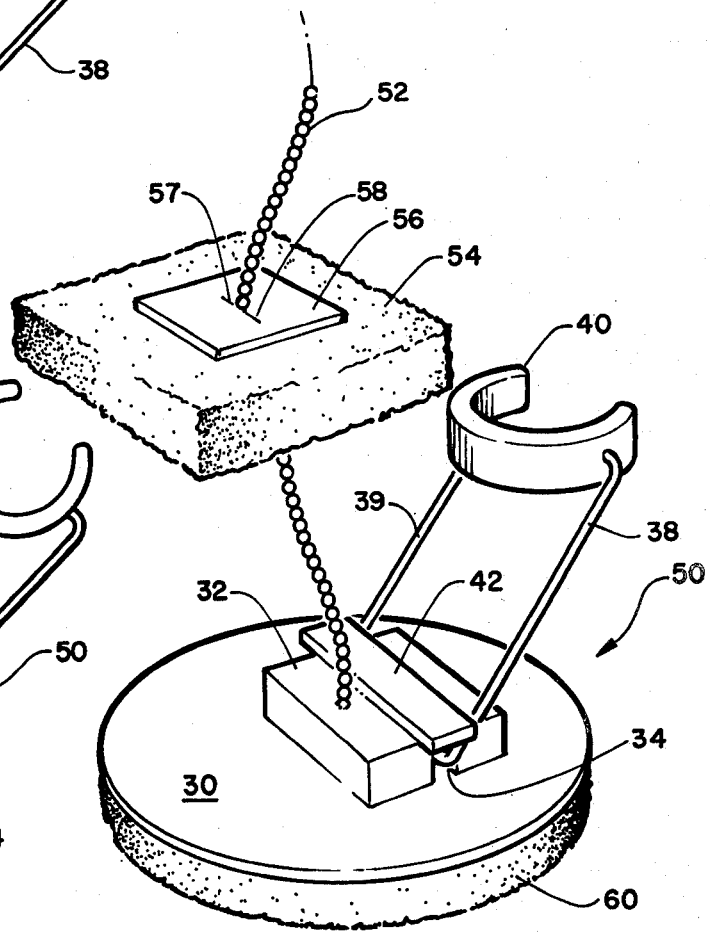
FIG. 4 is perspective view of a first alternative float valve assembly.
Figure 5:
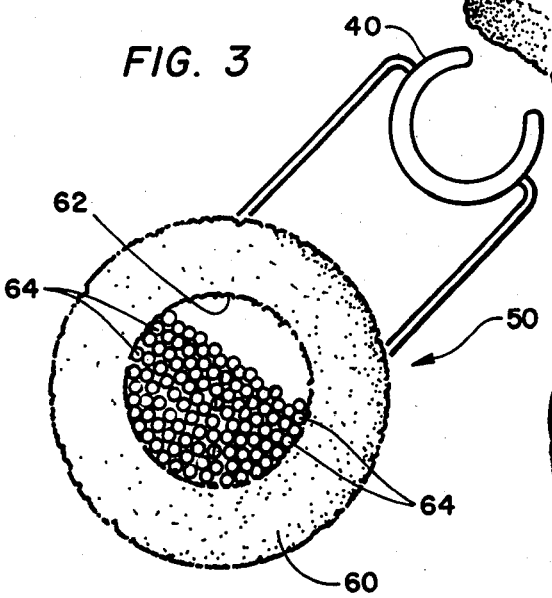
FIG. 5 is a bottom plan view of the floatmember of the alternative float valve assembly.

A first alternative novel float valve assembly is illustrated in FIGS. 4 and 5 and is generally designated numeral 50. The structure of float valve assembly 50 is generally the same as that of float valve assembly 26 and like numerals are used to describe the same parts in both. The basic difference in the structure is the use of a length of metal ball chain 52 whose bottom end is attached to the top of block member 32 and a supplemental float member 54 is mounted on that chain member. The float member 54 is made of polyvinyl chloride foam and it has a hole extending from its bottom surface through to its top surface through which metal chain 52 passes. A thin sheet of hard plastic material 56 is attached to the top surface of supplemental float member 54 and it has an apperture in it which is slightly smaller in diameter than the diameter of the balls on metal chain 52. A pair of slits 57 and 58 are formed in sheet 56 and extend to its aperture to provide a structure which will flex as the metal chain is pulled through the sheet material 56. In this manner the height of the supplemental float member may be adjusted along metal chain 52 and thereby change the amount of water which will be flushed when the water closet lever is actuated. In FIG. 5, the bottom of float member 60 is illustrated with central cutout portion 62. Into this cutout portion is placed a number of metal balls 64 that are glued in position to add weight to float member 60. The metal balls are located in the area of cutout portion 62 in the area which is fartherest from the C-clamp member 40. This aids in allowing the float member 60 to seat properly against a valve seat having inclined top surface that slopes away from the vertically oriented overflow tube.

What is claimed is:

1. In a water closet, the combination of:

(A) a flush tank for the storage of water, said tank having one opening in the bottom thereof and an outlet coupling located in said opening, the top of said outlet coupling is open and forms a valve seat, a substantially vertically oriented overflow tube has its lower end connected to said outlet coupling at a height below the top edge of said valve seat, a flushing drain pipe is connected to the lower end of said outlet coupling, and an actuating arm whose one end is connected to the lever that is used to flush the water closet;

(B) a float valve assembly comprising:

(1) a float member forming a valve cooperating with said valve seat for opening and closing the flushing opening of said outlet coupling, the valve seat of said outlet coupling having a predetermined diameter and said float member having a diameter greater than that of said valve seat, the bottom portion of said float member that seats on said valve seat being formed of polyvinyl chloride foam material, the bottom surface of said float member being substantially flat, (2) adaptor means for detachably securing said float valve assembly to said overflow tube, (3) flexible means connecting the top of said float member to the free end of said actuating arm, (4) substantially rigid connecting members having one of their ends pivotally attached to said adaptor means and their opposite ends pivotally attached to the top of said float member at a location spaced inwardly a predetermined distance from the peripheral edge of said float member thereby preventing said connecting members from pivoting downwardly any farther than the top surface of said float member.

2. A combination as recited in claim 1 wherein said adaptor means is a C-shaped clamp that snaps onto said overflow tube.

3. A combination as recited in claim 2 wherein said flexible means is a string-like member.

4. A combination as recited in claim 2 wherein said connecting members are part of a single wire member and the portion of the wire member that extends between one end of said connecting members is pivotally captured in a laterally extending groove in a block member mounted on the top surface of said float member.

5. A combination as recited in claim 1 further comprising a supplemental float member that is mounted on said flexible means connecting the top of said float member to the free end of said actuating arm.

6. A combination as recited in claim 5 wherein said supplemental float member and said flexible means have cooperating structure that allows said supplemental float member to be adjustably captured along the length of said flexible means.

7. A combination as recited in claim 6 wherein said primary float member has metal weights attached to its underside to overcome the buoyancy of said primary float member.

8. A float valve assembly comprising:

a float member forming a valve for cooperating with a valve seat for opening and closing the flushing opening of an outlet coupling, the valve seat of said outlet coupling having a predetermined diameter and said float member having a diameter greater than that of said valve seat, the bottom portion of said float member that seats on said valve seat being formed of polyvinyl chloride foam material, the bottom surface of said float member being substantially flat;

adaptor means for detachably securing the float valve assembly to an overflow tube in a water closet tank;

flexible means for connecting the top of the float member to the free end of an actuating arm in a water closet tank; and substantially rigid connecting members having one of their ends pivotally attached to said adaptor means and their opposite ends pivotally attached to the top of said float member at a location spaced inwardly a predetermined distance from the peripheral edge of said float member thereby preventing said connecting members from pivoting downwardly any farther than the top surface of said float member.

* * * * *